United States Patent [19]

Hoelzer et al.

[11] Patent Number: 4,714,977

[45] Date of Patent: Dec. 22, 1987

[54] ELECTRONIC DELAY TIMER

[75] Inventors: John S. Hoelzer, Wauwatosa; Richard J. Graefe, Milwaukee; James T. Libert, Waukesha, all of Wis.

[73] Assignee: Square D Company, Palatine, Ill.

[21] Appl. No.: 59,248

[22] Filed: Jun. 5, 1987

Related U.S. Application Data

[63] Continuation of Ser. No. 702,444, Feb. 19, 1985, abandoned, which is a continuation of Ser. No. 363,326, Mar. 29, 1982, abandoned.

[51] Int. Cl.[4] ..... H01H 47/32

[52] U.S. Cl. ..... 361/196

[58] Field of Search ..... 361/195–201; 307/592, 593, 596, 310; 340/815, 11, 519, 524

[56] References Cited

U.S. PATENT DOCUMENTS

| | | | |
|---|---|---|---|
| 3,721,908 | 3/1973 | Jurjans | 361/195 X |
| 3,727,526 | 4/1973 | Hinds | 361/196 X |
| 3,826,955 | 7/1974 | Fest | 361/196 |
| 3,963,947 | 6/1976 | Bogel | 361/196 X |
| 4,004,270 | 1/1977 | Claxton et al. | 340/524 |
| 4,012,673 | 3/1977 | Saarein et al. | 361/196 |
| 4,041,331 | 8/1977 | Westerman et al. | 307/311 |
| 4,079,272 | 3/1978 | Howatt | 307/311 |
| 4,090,107 | 5/1978 | Seib | 307/311 |
| 4,197,471 | 4/1980 | Lackey et al. | 307/311 |
| 4,260,912 | 4/1981 | Bjorke | 307/593 |
| 4,498,019 | 2/1985 | Berger | 361/195 X |

*Primary Examiner*—Michael L. Gellner

*Attorney, Agent, or Firm*—A. Sidney Johnston

[57] ABSTRACT

A machine tool timing relay has immunity from electrical noise on a control signal, and has an oscillator capable of generating pulses having a predetermined frequency, a means for adjusting the predetermined frequency over a continuous range of frequencies, a counter capable of counting the pulses and capable of generating an output signal after a predetermined number of the pulses are counted, means responsive to a start signal for initiating the counter to count the pulses, an optical isolator circuit responsive to the control signal for generating a light, detecting the light, and generating the start signal in response to detecting the light in order to isolate the counter from electrical noise mixed with the control signal, an electrical contact, and an output circuit responsive to the output signal for operating the electrical contact when the counter generates the output signal so that the contact is operated after the counter counts a predetermined number of the pulses. The contact is controlled after an interval of time required for the oscillator to generate the predetermined number of pulses. An electromechanical relay serves as the contact.

12 Claims, 3 Drawing Figures

ELECTRONIC DELAY TIMER

This application is a continuation of application Ser. No. 702,444, filed on Feb 19, 1985, now abandoned which is a continuation of Ser. No. 363,326, filed on Mar. 29, 1982, now abandoned.

BACKGROUND OF THE INVENTION

This invention relates to electronic delay timers of the type employing a counter to establish the time delay period.

Delay timers of the electro-mechanical type are well known. Often they comprise a timer motor which drives a switch actuator to different switch contacts selectively positioned in the path of the actuator according to the amount of delayed time desired. Such timers generally have two modes: on-delay and off-delay. Briefly, in the on-delay mode, a normally open switch is closed at the end of the time delay to actuate, or turn on, the device to be controlled by the timer. In the off-delay mode, a normally closed switch is opened at the end of the delay to de-actuate, or turn off, the controlled device connected therewith.

Electronic timers are also known in which the delay time is established by the RC time constants of various, or variable, RC timing circuits. An example of such a timer is shown in the U.S. Pat. No. 3,859,543 of Milovancevic.

More recently, delay timers have become available which employ one or more counters that count pulses from an oscillator. Examples of such timers are shown in U.S. Pat. Nos. 3,714,519 of Swinea, Jr.; 3,950,657 of Sheng, et al.; 3,987,316 of Bogel, et al.; 4,035,661 of Carlson; and 4,021,646 of Meier.

SUMMARY OF THE INVENTION

The object of the present invention is to provide an improved electronic delay timer which has greater noise immunity, a wider range of operation, improved precision of control and better status indication.

In keeping with this objective, we provide an electronic delay timer in which the delay is initiated by a circuit including an opto-isolator to reduce false starts caused by noise. A free running pulse oscillator is selectively coupled to a counter which generates a pulse on one of a plurality of selected outputs at the end of the selected delay time. The delay time range can be selectively varied by changing one of the oscillator components, such as a capacitor. Alternately or additionally, different ranges of timing can be achieved by selecting different ones of a plurality of counter outputs.

Fine adjustment to the delay time within each timing range is made by means of another oscillator component having a value which may be varied continuously. Such variation of the component value causes a continuous variation of the frequency of the oscillator within the range that has been preselected.

An indicator circuit is provided to control a light to indicate the three possible status conditions: standby, timing or timed out. When in the on-delay mode of operation, the indicating circuit causes a light to remain off during standby. When in the off-delay mode, this same circuit causes the light to remain on continuously during standby. During timing, the circuit causes the indicator light to flash on and off in either the on-delay or off-delay mode. After a delay period has timed out, the light is turned off continuously in the off-delay mode and is turned on continuously when in the on-delay mode.

In one embodiment, the light is caused to flash on and off at a frequency proportional to the oscillator frequency, so that it provides a gross indication of the timing range which has been preselected.

BRIEF DESCRIPTION OF THE DRAWINGS

The foregoing objects and advantages will be described in greater detail and further advantages and features will become apparent from the following detailed description of the preferred embodiment which is given with reference to the several views of the drawing, in which.

DETAILED DESCRIPTION

Figure 1:
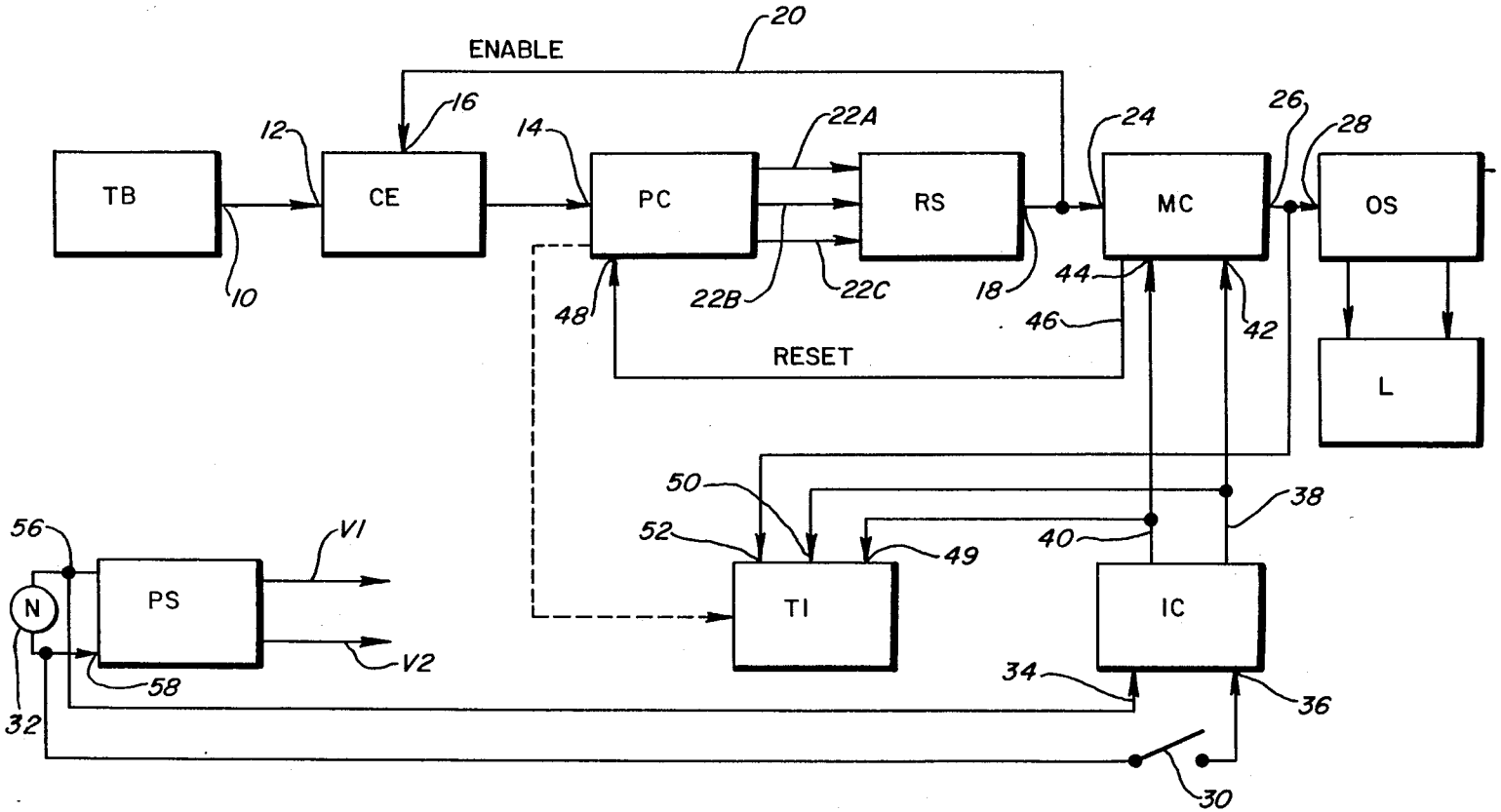
FIG. 1 is a functional block diagram of my delayed timer.

As seen in FIG. 1, the delay timer includes a time based circuit TB for generating timing pulses at a selected frequency which forms the basis for all subsequent timing operations. In keeping with one aspect of my invention, this frequency and thus the time delay period are continuously variable throughout a range of frequencies.

These time base pulses are coupled through an output lead 10 to the input 12 of a count enable circuit CE. Count enable circuit CE gates through the time base pulses at its input 12 to the input 14 of a pulse counter circuit PC whenever it is concurrently receiving an enable signal at its enable input 16. When an enable signal is not being provided at enable input 16, the count enable circuit CE blocks the pulses of the time base circuit TB from the input 14 of a pulse counter circuit PC. As a result, the pulse counter PC stops counting further pulses and holds the count stored therein when disablement occurred.

Another advantageous feature of my invention is the provision of a range select circuit RS which functions to provide a plurality of individually preselectable timing ranges. As noted above, within each of these ranges, the delay period may be continuously varied.

The enable signal is developed on the output 18 of a range select circuit RS and connected through a lead 20 to enable input 16. The pulse counter has three outputs, outputs 22A, 22B and 22C, respectively associated with three different timing ranges. Output pulses are produced on these outputs 22A, 22B and 22C respectively in response to the pulse counter PC reaching three different counts associated therewith.

Outputs 22A, 22B and 22C are coupled to three inputs of the range select circuit RS. The range select circuit RS functions to produce a lapsed time signal on its output 18 in response to production of an output pulse on a preselected one of these three outputs.

While the counter is counting, and before the count associated with the selected one of counter outputs 22A, 22B and 22C has been reached, range select circuit RS produces an enable signal. This enable signal is applied to enable input 16 of the circuit enable circuit CE. Accordingly, pulses from the time base circuit TB are applied to the inputs 14 of pulse counter PC, so long as the preselected count has not been reached.

When, however, the preselected count is reached, the lapsed time signal is generated on output 18 and the enable signal on lead 20 and count enable input circuit 16 is terminated. This causes the count enable circuit CE to block the application of further pulses to pulse counter 14.

Another advantageous feature of my invention is provision of a mode conversion circuit MC which enables the delay timer to selectively function as either an on-delay timer or an off-delay timer. The output 18 of range select circuit RS is connected to an input 24 of the mode control circuit MC. In turn, an output 26 of the mode control circuit MC is connected to an input 28 of an output section circuit OS.

The output section circuit OS has two opposite states: on and off. When the mode conversion circuit is placed in its on-delay mode, it generates a signal on its output 26 in response to a lapsed time signal at its input 24. This causes the output section OS to switch from its off state to its on state. Conversely, when the mode conversion circuit is in the off-delay mode, it causes the output section to switch from its on state to its off state. When in the on state, the output section 0S completes a circuit to a load L, and when in the off state, it interrupts this circuit with the load.

Initiation of the time delay period is achieved by means of an initiation circuit IC whenever a start switch 30 associated therewith is actuated. When start switch 30 is closed, AC power from a suitable source 32, such as standard 115 VAC, 60 hertz line voltage, is applied across inputs 34 and 36 of initiation circuit IC. When switch 30 is open, power is removed. As will be explained with reference to the circuitry of the initiation circuit IC, an opto-isolator and other noise immunity circuitry is advantageously employed to prevent inadvertent initiation of a time delay.

When in the on-delay mode of operation, closure of switch 30 results in generation of an initiate signal on output 40 which is applied to a mode conversion circuit input 44. The mode conversion circuit MC, in turn, removes a reset signal from its output 46 which is coupled to a reset input 48 of the pulse counter PC. This enables the pulse counter PC to begin counting, and when the preselected number of pulses have been counted, the output section is switched to its energized or on condition.

When in the off-delay mode of operation, the timer circuit is preconditioned for off-delay operation and is placed in standby when switch 30 is closed. Opening of switch 30 results in generation of an initiate signal on output 38 of initiate circuit IC which is applied to the mode conversion circuit input 42. Mode conversion circuit MC, in response to this signal, removes the reset signal otherwise applied to pulse counter PC. The pulse counter then commences counting pulses applied at its input 14. When the selected number of pulses have been counted, the output section is switched to its de-energized or off condition.

Initiation circuit outputs 38 and 40 are also coupled to inputs 50 and 52 of a timing indicator circuit TI. Another control input 52 of timing circuit TI is connected to output 26 of mode conversion circuit MC. The timing indicator circuit TI includes means responsive to these inputs to provide a flashing light indication while the delay timer is actually in the process of timing a delay. Otherwise, the light is either held continuously on or continuously off depending upon whether the delayed timer is in off-delay mode or in on-delay mode during standby or when timed out.

Figure 3:
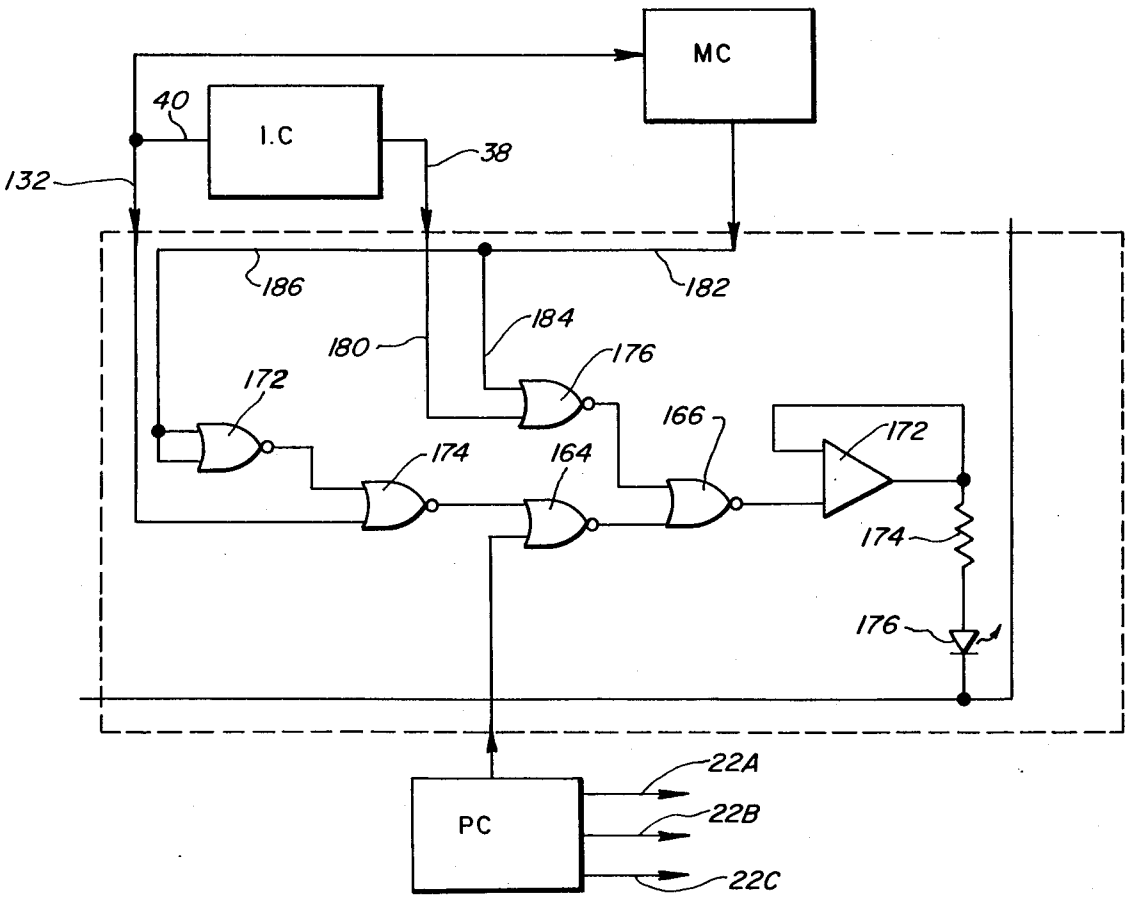
FIG. 3 is a circuit logic diagram of an alternate embodiment of the timing indicator portion of the circuit of FIG. 2.

In one embodiment, shown in detail in FIG. 3, the timing circuit TI responds to periodic pulses generated on the output 54 of an intermediate stage of pulse counter PC and applied to an input 56 to flash the light at a frequency proportional to that of the timing base circuit TB.

The output section circuit OS requires a DC voltage V1 and the other portions of the delayed timer require a regulated DC voltage V2 to function. These DC voltages are supplied by a power supply circuit PS which converts the AC power from a suitable source 32 to the required DC voltages V1 and V2. It should be appreciated that if DC power were otherwise available, power supply circuit PS could be eliminated or substituted with a DC-to-DC converter.

Figure 2:
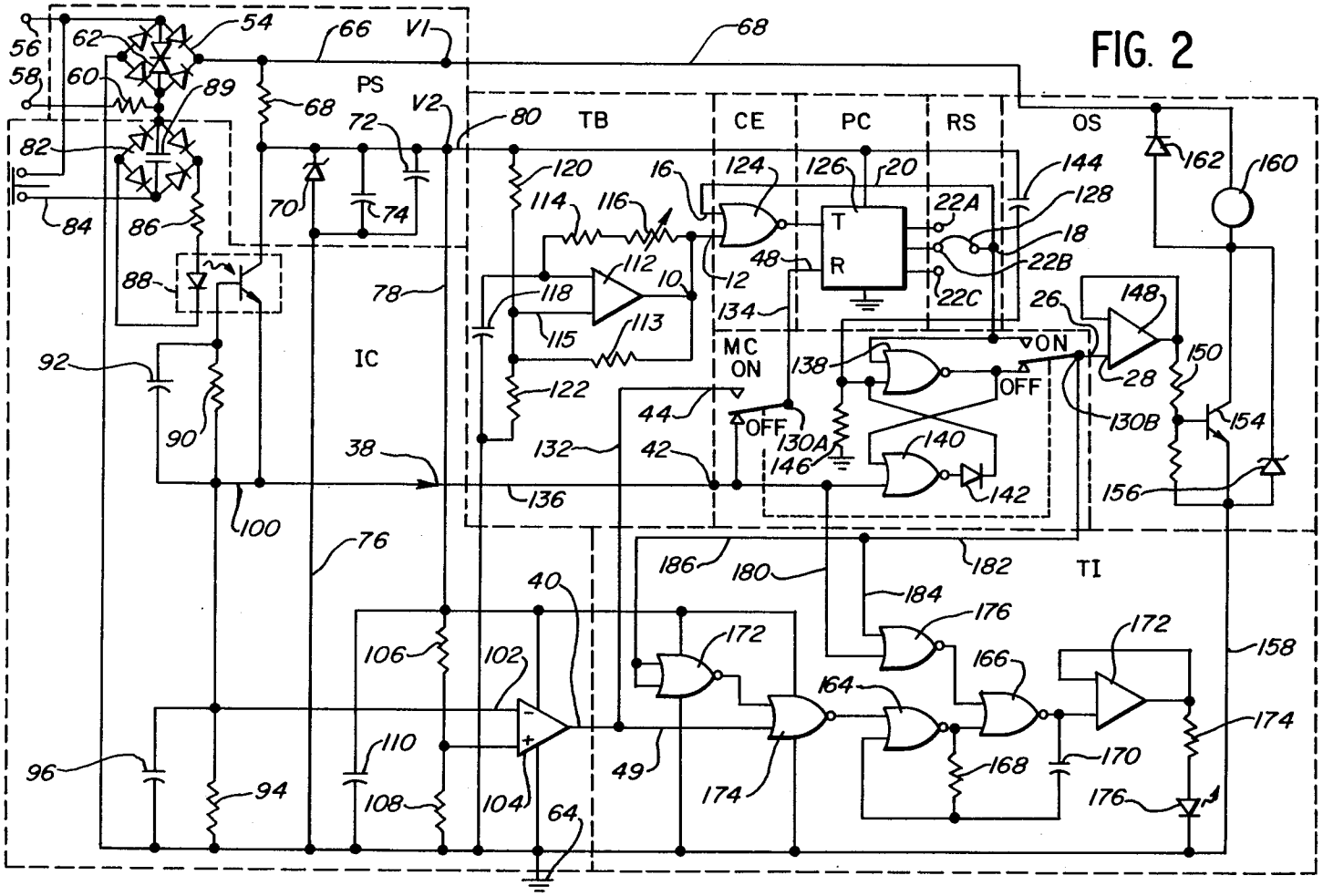
FIG. 2 is a schematic wiring diagram of a preferred embodiment of the circuitry corresponding to the functional blocks of FIG. 1.

Referring now to FIG. 2, a schematic diagram of particular circuitry for implementation of the functional circuit blocks of FIG. 1 is shown. The power supply circuit PS is seen to comprise a full wave bridge rectifier 54. The rectifier 54 has two inputs 56 and 58 connectable with a suitable source of AC power, such as source 32 of FIG. 1. The input 58 is connected through a resistor 60 which is provided together with an MOV switch 62 connected across inputs 56 and 58 for purposes of transient suppression. One of the outputs of bridge rectifier 54 is connected to ground reference potential 64.

The other output of rectifier 54 is directly connected through a lead 66 to power supply output V1. Produced at V1 is a 110 volt full wave unregulated voltage. Output V1 is coupled through a lead 68 to supply this full wave voltage output section circuit OS.

The power supply circuit PS also produces a smaller and rectified DC voltage, such as 12 volt DC, at output V2. The reduced voltage is produced from the higher unregulated voltage on lead 66 by means of a dropping resistor 68. Regulation and filtering is obtained by means of a zener diode 70 and filter capacitors 72 and 74. These are connected between their common junction with resistors 68 at output V2 and ground reference potential 64 through a ground lead 76. This regulated DC voltage at power supply output V2 is connected to the initiating circuit IC by a lead 78 and is connected to the remaining circuitry by means of a lead 80 to provide the regulated DC voltage thereto.

The intiating circuit also comprises a full wave bridge rectifier 82 which has one input connected to AC voltage input 58 through resistor 60 and another input connectable to AC voltage input 56 through means of a momentary contact switch 84. The initiating circuit IC also includes a voltage dropping resistor 86 and an opto-isolator 88. A resistor 90 and capacitor 92 connected in parallel therewith provide noise filtering to prevent inadvertent actuation of the opto-isolator 88. Noise filtering is also provided by a capacitor 89 connected across the inputs of bridge rectifier 82.

An RC reset time control network is provided by a second parallel resistor-capacitor combination comprising resistor 94 and capacitor 96. This RC reset time control network is connected between the output 100 of opto-isolator 88 and ground reference 64. Output 100 is connected to an input 102 of an operational amplifier 104. The output of operational amplifier 104 is output 40 of the initiating circuit IC which, as also shown in FIG. 1, is coupled to input 49 of the timing indicator circuit TI. The other input of operational amplifier 104 is coupled to the junction of two resistors 106 and 108 which provides this input with a positive bias voltage proportional to the DC voltage V2. A capacitor 110 connected in parallel with resistors 106 and 108 provides additional noise filtering for the operational amplifier 104.

When the switch 84 is in an open position, no power is applied to the input of the opto-isolator 88. Accordingly, the output of the opto-isolator 88 and thus the input 102 to operational amplifier 104 remains at ground reference potential, or a logic 0-state. Consequently, output 38 of initiating circuit, which is directly coupled with opto-isolator output 100, is also in a 0-state, and output 40 is in a logic 1-state.

When switch 84 is closed, the input to opto-isolator 88 is energized by means of rectifier 82, which causes the opto-isolator 88 to turn on and apply supply voltage V1 to its output 100. Consequently, a logic 1-state is applied to output 38 of intiating circuit IC and a logic 0-state is generated on output 40 a preselected time period thereafter determined by the time delay period of resistor 94 and capacitor 96. As will be explained in greater detail hereafter, this actuation of the switch 84 initiates a new time delay period.

The time base circuit TB comprises an operational amplifier 112 with a resistor 113 for coupling feedback from the output 12 of operational amplifier 112 to one of its inputs 115. The other input is coupled to the output 12 through a fixed resistor 114 and a variable resistor 160. This input is also connected through a timing capacitor 118 to ground reference. Positive voltage biasis applied to input 115 by means of a pair of bias resistors 120 and 122.

The time base circuit TB functions as a pre-running variable frequency isolator. The frequency is controllable by means of varying the resistance of variable resistor 116 or by changing the value of capacitor 118. In addition to, or in lieu of, variable resistor 116, capacitor 118 is implemented by means of a plurality of capacitors of different values associated with different timing ranges and a switch for selectively connecting individual ones of those capacitors in circuit with the operational amplifier 112.

The output 10 of this time base circuit TB is connected to input 12 of the count enable circuit CE, as also shown in FIG. 1. As seen in FIG. 2, the count enable circuit CE comprises a NOR gate 124 the output of which is connected to input 14 of pulse counter circuit TC and the two inputs of which are respectively coupled to enable inputs 12 and 16. The signal applied to enable input 16 is taken from the output 18 of range select circuit RS. When the range select circuit provides a logic 1-state signal to enable input 16, either before or after completion of a delay period, NOR gate 124 is disabled from responding to the oscillator pulses at its input 12. Instead, a steady 0-state signal is applied to pulse counter input 14. At the initiation of a delay period, on the other hand, a 0-stated signal is applied to input 16 and NOR gate 124 is thus enabled to respond to the oscillator pulses at its input 12. Whenever a 1-state signal is applied at its input 12, a 0-state pulse is generated by NOR gate 124 and applied to input 14, and vice versa.

The pulses are applied to input 14 of pulse counter circuit PC when a logic 0-state signal is applied to the reset input 48 of the pulse counter circuit PC. The counter continues to count until the predetermined number of pulses for the selected delay period have been counted. When that occurs a 1-state signal appears on the selected one of a plurality of outputs 22A, 22B and 22C.

As shown in FIG. 2, the rate select circuit is provided with a connector 128 for making connection with a selected one of outputs 22A, 22B and 22C and output 18 of the range select circuit RS. As previously noted, output 18 is coupled through a lead 20 to disable input 16 of count enable circuit CE. Thus, when the preselected count is reached and a 1-state signal is generated on the selected one of the outputs, such as output 22B, a 1-state signal is applied to disable input 16 which causes NOR gate 124 to block further pulses to counter input 14. The counter thus stops counting with the preselected count stored therein and a 1-state signal maintained on the output of range select circuit RS.

When a logic 1-state is applied to counter reset input 48, all of outputs 22A, 22B and 22C are held at a logic 0-state. In addition, the counter is reset to a count of zero and is disabled from counting any pulses applied to input 14.

The mode control circuit MC includes a double-pole, double throw switch having two sections 130A and 130B. The two contacts of mode control switch section 130A is one respectively connected to mode control inputs 42 and 44. When section 130A is in its on-delay position opposite to that shown, output 40 of initiation circuit IC is coupled to counter reset input 48 through a lead 132, switch section 130A and lead 134. When switch section 130A is in the off-delay position, on the other hand, this connection is broken, and another connection is made to counter reset input 48 through lead 134, switch 130A and lead 136 to output 38 of initiating circuit IC.

The mode control circuit MC also includes a flip-flop comprising a pair of cross connected NOR gates 138 and 140. In addition, a diode 142 is provided to isolate the common input of NOR gate 138 from an output of NOR gate 140. A capacitor 144 and resistor 146 comprise an off return network. This off return network insures that the output is de-energized if power is applied when the delayed timer is in the off-delay mode.

When switch section 130B is in the on-delay position, opposite to that shown, output 26 of mode control circuit MC is coupled through switch section 130B to output 18 of range select circuit RS. When in the on-delay mode, output 26 is maintained in a 0-state until the preselected count is reached, at which time it is switched to a 1-state.

With switch section 130B in the off-delay position, as shown, output 26 of the mode control circuit is taken from the output of NOR gate 138. Accordingly, a 1-state signal is applied from NOR gate 138 to output 26 until lapse of the preselected time period. When this occurs, a 1-state signal from output 18 of range select circuit RS and applied to the input of NOR gate 138 causes it to switch its output and thus output 26 to a 0-state.

The output section circuit OS comprises an operational amplifier driver 148 which has its input 28 directly connected to mode conversion circuit output 26. The output of operational amplifier 148 is coupled through bias resistors 150 and 152 to an NPN transistor 154. A zener diode 156 is coupled in parallel with transistor 154 to provide transient protection thereto. The emitter of transistor 154 is coupled through a lead 158 to ground reference 64, and the collector is coupled to the coil 160 of an output relay. An optional free wheeling diode 162 is coupled in parallel with relay coil 160.

The timing indicator circuit comprises three different sub-circuits. An oscillator is formed by NOR gates 164 and 166 together with a resistor 168, a capacitor 170 and the inter-connection therebetween. A control for this oscillator is provided by NOR gate 172, 174 and 176. An LED driver circuit, comprising an operational amplifier 172 and a current limiting resistor 174 is driven by the oscillator to energize a light emitting diode 176 to provide an indication of timing.

When in the on-delay mode, and AC power is being applied to rectifier inputs 56 and 58, the delay timer is in a standby condition. The opto-isolator 88 is in a non-conductive state, and input 102 of operational amplifier 104 is held in a 0-state by resistor 94. This causes operational amplifier 104 to provide a 1-state signal on its output 40 which, in turn, is applied to counter reset input 48 to maintain counter 126 in a reset condition. In this condition, all of outputs 22A, 22B and 22C are in a 0-state, and the counter is not responsive to any pulses being applied to its input 14. This 0-state signal is coupled through range select circuit output 18 to input 28 of operational amplifier 148. Operational amplifier 148, in turn, provides a 0-state signal on its output which keeps the transistor 154 in a non-conductive state and thus relay coil 160 de-energized.

A logic 0-state signal on output 38 of initiating output AC is coupled through a lead 180 to one input of timing indicator circuit NOR gate 176, and a 0-state signal from range select circuit output 18 and switch section 130B is coupled through leads 182 and 184 to the other input of NOR gate 176. These two 0-state signals applied to NOR gate 176 causes it to produce a 1-state signal on its output. This 1-state signal is applied to an input of NOR gate 166 which, in turn, produces a 0-state signal on its output. This 0-state signal is applied to operational amplifier 172 which, in response thereto, maintains the light emitting diode 176 in a de-energized state.

When switch 84 is closed, the opto-isolator 88 turns on which causes the application of the 1-state signal to be applied to input 102 of operational amplifier 104. This causes the output 40 of operational amplifier 104 to switch to a 0-state. This 0-state signal is applied through switch section 130A to reset input 48 and enables the counter 126 to start counting pulses applied to its input 14. The 1-state signal on initiating circuit output 38 also causes the output of NOR gate 176 to switch to a 0-state to enable operation of the LED oscillator. The oscillation of the oscillator then commences which causes the light emitting diode 176 to flash on and off to signify that timing has commenced.

Once the predetermined number of pulses have been counted by counter 126, the output 18 of range select circuit switches to a 1-state. This 1-state signal applied to NOR gate 124 of code enable circuit CE disables the application of further pulses to counter 14 and thus stops the counter from counting. In addition, this 1-state signal coupled to input 28 of operational amplifier 148 causes it to turn on transistor 154 and thereby energize relay coil 160.

The logic 1-state signal from output 18 of range select circuit RS is applied to the input of NOR gate 172 through switch section 130B, lead 182 and a lead 186. This 1-state signal causes the output of NOR gate 172 to switch to a 0-state signal. This 0-state signal is applied to one of the inputs of NOR gate 174. The other input to NOR gate 174 is taken from output 40 of initiating circuit IC which is also in a 0-state. Accordingly, NOR gate 174 generates a 1-state signal on its output which causes the application of a 0-state signal to one of the inputs of NOR gate 166 from the output of NOR gate 164. The other input to NOR gate 166 is obtained from the output of NOR gate 176 which is also in a 0-state. Accordingly, NOR gate 166 generates a continuous 1-state signal on its output which maintains the light emitting diodes 176 continuously, rather than intermittently, energized to indicate that the time delay circuit has timed out.

During standby, the output transistor of opto-isolator 88 remains in cutoff. This result in production of a 0-state signal on output 38 which is applied to reset input 48 of counter 126, when the counter is enabled to count oscillator pulses. Output 26 of load conversion circuit MC is taken from the output of flip-flop NOR gate 138. However, the 0-state signal on output 38 of initiating circuit IC is applied to the reset input of flip-flop NOR gate 140. As a result, a 1-state signal is applied to the cross connected input of flip-flop NOR gate 138. This 1-state signal keeps the output of NOR gate 138 thus output 126 in a 0-state addition regardless of the state of the signal applied to the other input of flip-flop NOR gate 138 from rate select circuit output 18. This 0-state signal on output 26 is applied to input 28 of operational amplifier 148 which, in turn, maintains the transistor 154 in a non-conductive state and relay coil 160 de-energized. Logic 0-state signals are applied to both inputs of NOR gate 176 of timing indicator circuit TI which keeps the light emitting diode 176 in a de-energized condition indicating the standby mode.

When switch 84 is closed, the output transistor of opto-isolator 88 turns on to apply a 1-state signal to reset input 48 of counter 126 and to the reset input of flip-flop NOR gate 140. This causes the flip-flop to be reset and it enables flip-flop NOR gate 138 to respond to a 1-state signal from output 18 of range select circuit RS. This causes the output 18 of range select circuit RS to switch to a 0-state which enables the code enable NOR gate 124 to respond to oscillator pulses and apply them to input 14. However, the 1-state signal being applied to reset input 48 prevents the counter 126 from responding to these pulses, and the count remains at zero. The 1-state signal produced on the output of flip-flop NOR gate 138 applied to input 28 of operational amplifier 148. This causes the transistor 154 to turn on and energize output relay coil 160.

The 1-state signal on output 26 is also coupled through lead 182 and lead 186 through the inputs of NOR gate 172. This causes the application of a 0-state signal to the input of NOR gate 174. The logic 1-state signal from the output transistor of opto-isolator 88 is applied to input 102 of operational amplifier 140. Operational amplifier 140, in turn, produces a 0-state signal on its output 40 that is applied to the other inputs of NOR gate 174. Accordingly, NOR gate 174 produces a 1-state signal on its output with disabled NOR gate 164. In addition, the two 0-state signals applied to the inputs of NOR gate 176 results in a 1-state signal being applied to NOR gate 166. The two 0-state signals applied to the inputs of NOR gate 166 causes it to produce a 1-state signal on its output. This 1-state signal causes the light emitting diode 176 to be continuously energized showing that the delay timer is in its off-delay mode during standby with the relay being energized.

When switch 84 is re-opened, the output transistor of opto-isolator 88 turns off. This causes a 0-state signal to be applied to reset input 48 to enable counter 126 to start counting pulses. In addition, 0-state signal is applied to remove the 1-state signal from the reset input of flip-flop NOR gate 140. This has no effect, and the flip-flop NOR gate 138 continues to produce a 1-state signal on its output to keep the relay coil 160 energized.

In the timing indicator circuits, a 0-state signal is applied to input 102 of operational amplifier 104. This results in the production of a 1-state signal on the output 140 applied to one input of NOR gate 174. The 1-state signal results in the application of a 0-state signal to the one input of NOR gate 174. NOR gate 176 applies a 0-state signal to input of NOR gate 166. Under these conditions, the oscillator formed by NOR gates 164 and 166 is enabled to oscillate and the light emitting diode 176 is thereby intermittently energized and periodically flashed to indicate timing.

After the predetermined number of pulses have been counted by counter 126, output 18 of rate select circuit RS switches to a 1-state signal. This sets the flip-flop and the output of NOR gate 138 switches to a 0-state signal. Accordingly, base drive is removed from output section transistor 154 and output relay coil 160 is de-energized. In the timing indicator circuit TI, the logic 1-state signal on output 18 is also applied through lead 20 to input 16 of NOR gate 124 to disable counter 126 from counting any further pulses. Accordingly, the 1-state signal on output 18 remains. In the timing indicator circuit, the two 0-state signals applied to the inputs of NOR gate 176 causes it to switch its output to a 1-state. This 1-state signal is applied to the input of NOR gate 166 which in turn results in the continuous de-energization of light emitting diode 176 to indicate that the device is in a standby mode once again.

Referring to FIG. 3, an alternate embodiment of the timing indicator portion of my time delay circuit is shown. This circuit is identical to that embodiment shown in FIG. 2 except for the elimination of resistor 166 and capacitor 170 and the substitution therefor with a connection from an intermediate stage of pulse counter PC being coupled to one of the inputs of NOR gate 164. With this connection, the timing indicator circuit will cause the light emitting diode 176 to flash at a frequency which is proportional to the frequency of the oscillator timing base circuit TB. Accordingly, the rate of flashing of the light emitting diode 176 will be proportional to the frequency of the oscillations of timing base circuit TB. Accordingly, the rate of flashing will indicate the time delay range which has been selected. The embodiment of FIG. 3 otherwise operates in an identical fashion as the timing indicator circuit in FIG. 2.

We claim:

1. A machine tool timing relay having immunity from electrical noise on a control signal comprising:

an oscillator capable of generating pulses having a predetermined frequency;

means for adjusting said predetermined frequency over a continuous range of frequencies;

a counter capable of counting said pulses and capable of generating an output signal after a predetermined number of said pulses are counted;

means responsive to a start signal for initiating said counter to count said pulses;

an optical isolator circuit, responsive to said control signal for generating a light, detecting said light, and generating said start signal in response to said detecting said light in order to isolate said counter from electrical noise mixed with said control signal;

an electrical contact; and an output circuit responsive to said output signal for operating said electrical contact when said counter generates said output signal so that said contact is operated after said counter counts a predetermined number of said pulses, thereby providing control over said contact after an interval of time required for said oscillator to generate said predetermined number of said pulses, and said means for adjusting said frequency providing continuous adjustment of said interval of time.

2. The apparatus as in claim 1 wherein said electrical contact further comprises an electromechanical relay operated in response to said output signal.

3. The apparatus as in claim 1 further comprising a bridge rectifier responsive to said alternating current for supplying direct current power for generating said light.

4. The apparatus as in claim 1 further comprising:

means for generating a light which flashes at a frequency substantially proportional to said preselected time period.

5. The apparatus as in claim 1 wherein said counter has a plurality of outputs on which are generated pulses at the ends of different selected time periods.

6. The apparatus of claim 5 comprising in addition means for preselecting different ones of said outputs in order to select the range of said interval of time.

7. The apparatus as in claim 1 further comprising:

means for selecting whether said electrical contact is opened or closed when said contact is operated.

8. A machine tool timing relay comprising:

an oscillator capable of generating pulses having a predetermined frequency;

means for adjusting said predetermined frequency over a continuous range of frequencies;

a counter capable of counting said pulses and capable of generating an output signal after a predetemined number of said pulses are counted;

means responsive to a start signal for initiating said counter to count said pulses;

an optical isolator circuit, responsive to a control signal for generating a light, detecting said light, and generating said start signal in response to said detecting said light in order to isolate said counter from electrical noise mixed with said control signal;

an electromechanical relay; and an output circuit responsive to said output signal for operating said electromechanical relay when said counter generates said output signal so that said contact is operated after said counter counts a predetermined number of said pulses, thereby providing control over said electromechanical relay after an interval of time required for said oscillator to generate said predetermined number of said pulses, and said means for adjusting said frequency providing continuous adjustment of said interval of time.

9. A machine tool timing relay having immunity from electrical noise on a control signal comprising:

an oscillator capable of generating pulses having a predetermined frequency;

means for adjusting said predetermined frequency over a continuous range of frequencies;

a counter capable of counting said pulses and capable of generating an output signal after a predetermined number of said pulses are counted;

means responsive to a start signal for initiating said counter to count said pulses;

an electrical contact; and an output circuit responsive to said output signal for operating said electrical contact when said counter generates said output signal so that said contact is operated after said counter counts a predetermined number of said pulses, thereby providing control over said contact after an interval of time required for said oscillator to generate said predetermined number of said pulses, and said means for adjusting said frequency providing continuous adjustment of said interval of time.

10. A machine tool timing relay having immunity from electrical noise on a control signal comprising:

an oscillator capable of generating pulses having a predetermined frequency;

means for adjusting said predetermined frequency over a continuous range of frequencies;

a counter capable of counting said pulses and capable of generating an output signal after a predetermined number of said pulses are counted;

means responsive to a start signal for initiating said counter to count said pulses;

an optical isolator circuit, responsive to said control signal for generating a light, detecting said light, and generating an output voltage;

a capacitor and a resistor for integrating said output voltage of said optical isolator to generate said start signal in order to isolate said counter from electrical noise mixed with said control signal;

an output circuit responsive to said output signal for operating said electrical contact when said counter genrates said output signal so that said contact is operated after said counter counts a predetermined number of said pulses, thereby providing control over said contact after an interval of time required for said oscillator to generate said predetermined number of said pulses, and said means for adjusting said frequency providing continuous adjustment of said interval of time.

11. A machine tool timing relay having immunity from electrical noise on a control signal comprising:

an oscillator capable of generating pulses having a predetermined frequency;

means for adjusting said predetermined frequency over a continuous range of frequencies;

a counter capable of counting said pulses and capable of generating an output signal after a predetermined number of said pulses are counted;

means responsive to a start signal for initiating said counter to count said pulses;

means for changing said predetermined number of said pulses counted by said counter, in order to change a timing range of said machine tool timing relay;

an electrical contact; and an output circuit responsive to said output signal for operating said electrical contact when said counter generates said output signal so that said contact is operated after said counter counts a predetermined number of said pulses, thereby providing control over said contact after an interval for time required for said oscillator to generate said predetermined number of said pulses, and said means for adjusting said frequency providing continuous adjustment of said interval of time.

12. A machine tool timing relay having immunity from electrical noise on a control signal comprising:

an oscillator capable of generating pulses having a predetermined frequency;

means for adjusting said predetermined frequency over a continuous range of frequencies;

a counter capable of counting said pulses and capable of generating an output signal after a predetermined number of said pulses are counted;

means for changing said predetermined number of said pulses counted by said counter, in order to change a timing range of said machine tool timing relay;

means responsive to a start signal for initiating said counter to count said pulses;

an optical isolator circuit, responsive to said control signal for generating a light, detecting said light, and generating an output voltage;

a capacitor and a resistor for integrating said output voltage of said optical isolator to generate said start signal in order to isolate said counter from electrical noise mixed with said control signal;

an output circuit responsive to said output signal for operating said electrical contact when said counter generates said output signal so that said contact is operated after said counter counts a predetermined number of said pulses, thereby providing control over said contact after an interval of time required for said oscillator to generate said predetermined number of said pulses, and said means for adjusting said frequency providing continuous adjustment of said interval of time.

* * * * *